US009239212B1

(12) United States Patent
Leko et al.

(10) Patent No.: US 9,239,212 B1
(45) Date of Patent: Jan. 19, 2016

(54) RETROFIT FIREARM ILLUMINATION APPARATUS

(71) Applicants: Christopher Leko, North Hills, CA (US); Steven M. Beumer, Chatsworth, CA (US)

(72) Inventors: Christopher Leko, North Hills, CA (US); Steven M. Beumer, Chatsworth, CA (US)

( * ) Notice: Subject to any disclaimer, the term of this patent is extended or adjusted under 35 U.S.C. 154(b) by 48 days.

(21) Appl. No.: 14/461,288

(22) Filed: Aug. 15, 2014

(51) Int. Cl.

| | |
|---|---|
| ***F21L 4/04*** | (2006.01) |
| ***F41G 1/35*** | (2006.01) |
| ***F21L 4/08*** | (2006.01) |
| ***F21V 5/00*** | (2015.01) |
| ***F21V 23/04*** | (2006.01) |
| ***F21V 23/06*** | (2006.01) |
| ***F21V 17/16*** | (2006.01) |

(52) U.S. Cl.
CPC ... *F41G 1/35* (2013.01); *F21L 4/08* (2013.01); *F21V 5/006* (2013.01); *F21V 17/162* (2013.01); *F21V 23/0421* (2013.01); *F21V 23/06* (2013.01)

(58) Field of Classification Search
CPC ..... F21V 33/00; F21V 33/004; F21V 23/04; F21V 23/0414; F21V 23/06; F21S 6/001; F21L 4/00; F21L 4/027; F21L 4/08; F21L 13/04; F21L 13/06; F21L 13/08
USPC ..... 362/110, 111, 201, 202–206
See application file for complete search history.

(56) References Cited

U.S. PATENT DOCUMENTS

| | | | | |
|---|---|---|---|---|
| 5,673,996 | A * | 10/1997 | Ducker | B43K 29/10 362/118 |
| 6,190,025 | B1 * | 2/2001 | Solinsky | F21V 23/04 200/43.11 |
| 6,261,018 | B1 * | 7/2001 | Chen | B43K 29/10 362/118 |
| 7,044,672 | B2 * | 5/2006 | Yu | B43K 29/10 362/118 |
| 7,152,990 | B2 * | 12/2006 | Kukuk | F21V 33/0064 222/113 |
| 7,204,606 | B2 * | 4/2007 | Brass | G01N 21/31 362/184 |
| 8,220,950 | B1 * | 7/2012 | Sunshine | G08B 5/002 315/291 |
| 8,960,942 | B2 * | 2/2015 | Galli | F41G 11/004 315/210 |
| 2007/0145912 | A1 * | 6/2007 | Spartano | F21S 6/001 315/291 |
| 2008/0134562 | A1 * | 6/2008 | Teetzel | F41G 11/003 42/146 |

* cited by examiner

*Primary Examiner* — Ali Alavi
(74) *Attorney, Agent, or Firm* — Omni Legal Group; Omid E. Khalifeh

(57) ABSTRACT

An apparatus providing a regenerative light source capable of illuminating a large area in front of and around the barrel end of a firearm. The apparatus may be installed as a retrofit into the firearm body without any need to alter it. Moreover, the light source and the electronics powering are will be shielded from environmental hazardous associated with the operation of a firearm thus prolonging the life of the apparatus while ensuring it remains functional whenever needed.

19 Claims, 5 Drawing Sheets

RETROFIT FIREARM ILLUMINATION APPARATUS

CROSS-REFERENCE TO RELATED APPLICATIONS

None.

NOTICE OF COPYRIGHT AND TRADE DRESS

A portion of the disclosure of this patent document contains material which is subject to copyright protection. This patent document may show and/or describe matter which is or may become trade dress of the owner. The copyright and trade dress owner has no objection to the facsimile reproduction by any one of the patent disclosure as it appears in the Patent and Trademark Office patent files or records, but otherwise reserves all copyright and trade dress rights whatsoever.

TECHNICAL FIELD

The present invention relates generally to a retrofit assembly for use with a firearm and, more particularly, to an illumination apparatus that may be installed within a firearm to assist with aiming and shooting a firearm in varying ambient light conditions.

DISCUSSION OF THE RELATED ART

Light beams have long been used as sight aids for weapons. When ambient light conditions may vary from low light to complete darkness, an improved aiming device that allows quicker and more accurate aiming of a weapon becomes an advantage. Particularly with law enforcement, armed forces and security personnel for whom, under life threatening situations, a fraction of a second can mean the difference between life or death.

It is known in the art to provide a light source within a hand gun such as a semiautomatic pistol. For example, laser sights for weapons are well known in the art. The prior art teaches that lasers be used as a means of generating light beams for sighting applications. Lasers have come to be known for their high intensity, small spot size, and how they can be focused into a narrow beam with minute divergence angles. Although they provide a distinct advantage, they are ineffective when it becomes desirous to illuminate a large space to asses potential threats contained therein.

In the past, one way this problem had been addressed was by holding a lighted flashlight with the hand not holding the firearm or, in some instances, mounting the flashlight to the outside of the firearm. In a critical situation, the execution of this method can expose individuals to unnecessary risk. Having to reach for and separately operate a flashlight results in lost time and an impaired response. This is a problem that becomes compounded even further when the person operating the weapon finds themselves in a situation whereby lost time can expose them to life threatening danger.

Various devices have been suggested in an attempt to provide solutions to the aforementioned problems. However, some of these proposals are not desirable because they are bulky, heavy and require advanced and/or expensive adaptations to be made to a firearm in order to retrofit the device. Luminous sights have been proposed that use light emitting diodes (LED) as a means of illumination. These proposed luminous sights comprise bare LED lamps without any means of modification of the quality of light which is radiated away from and viewed by the user. The excessive amount of glare produced by these types of light sources make them extremely difficult to view and can be distracting and/or irritating.

One example of an illuminated site comprising LED lamps is in U.S. Pat. No. 3,833,799. The '799 patent discloses an illuminated gun sight system which uses an LED lamp as an isolated frontal sight element in a supplemental installation on a conventional front gun sight of a firearm. This illuminated frontal sight is intended to be viewed by the user as a pinpoint of light through a rear conventional iron sight and is therefore not a solution for firearms lacking this feature.

Patent application Ser. No. 10/846,271 teaches an LED adapted to protrude from the front of the firearm. A gun with such a light source cannot generally be carded in a conventional holster. This is a substantial drawback caused by the fact the LED may be easily damaged or knocked out of alignment with the barrel of the firearm. Moreover, positioning the light source in such a hazardous environment as the outside of the firearm exposes it to spray back, led dust, burnt powder, carbon deposits, and other substances that significantly reduce the functionality and lifespan of the light source. Moreover, this application provides no means for adjusting the alignment of the light beam relative to the weapon boresight.

Furthermore, the use of a bare LED lamp on a gun sight, without modification of the light emitted therefrom, presents a problem of inaccuracy. This is because the physical center of the LED lamp does not coincide exactly with the physical location of the illuminating crystal embedded within the lamp. The pinpoint of light inside the LED lamp is of uncertain location due to structural inconsistencies inherent in the manner in which these devices are manufactured. This is an inherent characteristics of LED lamps which presents a problem of inconsistency and inaccuracy.

Accordingly there exists a need for a bright light source which may be installed as a retrofit on a firearm that comprises a means for protecting the light source from environmental hazardous tangential to use in close proximity with the barrel of a firearm. It would be further desirous for such a retrofit to allow the user to make adjustments to the light beam. An additional need is for such a retrofit to be comprised of lightweight materials and comprise state of the art light and battery technology without adding any bulk of the weapon. The present invention effectuates these needs.

SUMMARY

An apparatus is herein disclosed for providing a regenerative light source capable of illuminating a large area in front of and around the barrel end of a firearm. The apparatus may be installed as a retrofit into the firearm body without any need to alter it. The light source and the electronics powering it will be shielded from environmental hazardous associated with the operation of a firearm such as spray back, led dust, burnt powder, and carbon deposits thus prolonging the life of the apparatus while ensuring it remains functional whenever needed.

The apparatus of the present invention is comprised of a hollow chamber with a front end which is fixed on the distal end zone of the firearm's barrel and a rear end which is fixed on the proximal end zone of the firearm's barrel. The chamber is comprised on an electrically conductive material by way of example, an not limitation, stainless steal. An illumination means is located within the chamber and is operative to radiate highly luminous light substantially parallel in relation to the central longitudinal axis of the barrel. A means for reflecting or refracting light is further provided to adjust, among other things, the reference shape of uniform light intensity throughout the visible light radiating area of the illumination source.

The apparatus further comprises a means for providing electric current to the illumination source housed within the hollow chamber. In one embodiment, the current providing means may be a series of button-type silver oxide (SR) batteries. SR batteries have been found to have superior characteristics making them well suited for use within a firearm and powering a highly luminous light source. These batteries exhibit a flat discharge curve during which they supply a stable voltage until the end of the discharge life. A flat discharge curve during discharge means a more stable voltage until the end of the discharge life ensuring consistency in the amount and type of illumination. Excellent discharge load characteristics and leakage resistance make them a superior alternative to commonly used alkaline varieties.

The manual on/off switch of the present disclosure is a retrofit piece shaped to mimic the take down lever of the firearm while being capable of completing the circuit which provides current to the illumination source. The apparatus further comprises an end cap for engaging the rear of the chamber having a metal electrical contact. The metal electrical contact engages the retrofit take down lever which is movable horizontally to selectively contact the metal contact for making selective electrical contact therewith. The circuit may be completed by sliding the take down lever either to the left or to the right. When the lever is in the center, a small piece of insulating material, disposed in the center of the lever, engages the electrical contact thus shutting off the light source.

A further feature of the apparatus described herein is a highly luminous light source with substantially greater power and intensity than any light source heretofore disclosed in the art of the present disclosure. By using a light source powered by the aforementioned current providing means, the light source of the present apparatus can emit 40,000 mcd of high intensity light. This amounts to approximately four times the luminosity of any previously disclosed light source. This substantial increase pays dividends in the perilous situations commonly faced by law enforcement officials where it is essential quickly and accurately identify potential threats.

Furthermore, the substantial increase in light intensity means the light source no longer needs to be fitted to the outside of the firearm in order to be effective. Accordingly, the light source of the present disclosure is secured to the inside of the hollow chamber nestled within the firearm where it is safe from environmental hazards which would otherwise damage the light source. Situating the light source in such a manner means additional space is made available at the front of the chamber for receiving a means of reflecting and refracting the emitted light. In one embodiment, this may be a lens that also provides an additional layer of protection by further isolating the light source from the environmental hazards outside of the firearm.

In one embodiment, the light source will be secured within the chamber using an optical adhesive. An optical adhesive comprises a lower refractive index than conventional adhesives to ensure nominal impact on the luminosity and clarity of the light source. Furthermore, optical adhesives have low viscosity, fast curability, and excellent heat resistance properties all of which make it ideally suited for use within a firearm.

An object of the apparatus is to provide an assembly for use on a firearm and, specifically, a regenerative high luminous efficiency light source isolated from the hazardous which may denigrate the light source reducing its life span and efficacy.

A further object of the present disclosure is to provide a retrofit illumination apparatus to facilitate accurate aiming of a firearm in all ambient light conditions by emitting high luminous efficiency light from the distal end of a firearm.

It is still a further object of the present invention to provide an assembly for use on a firearm including luminous elements on the front wherein the entire assembly may be retrofit into the firearm and does not substantially alter the size, shape, or weight of the firearm. Numerous other features, objects and advantages of the invention will become apparent from the following description when read in conjunction with the accompanying drawings.

DESCRIPTION OF THE DRAWINGS

Figures

Figure 1:
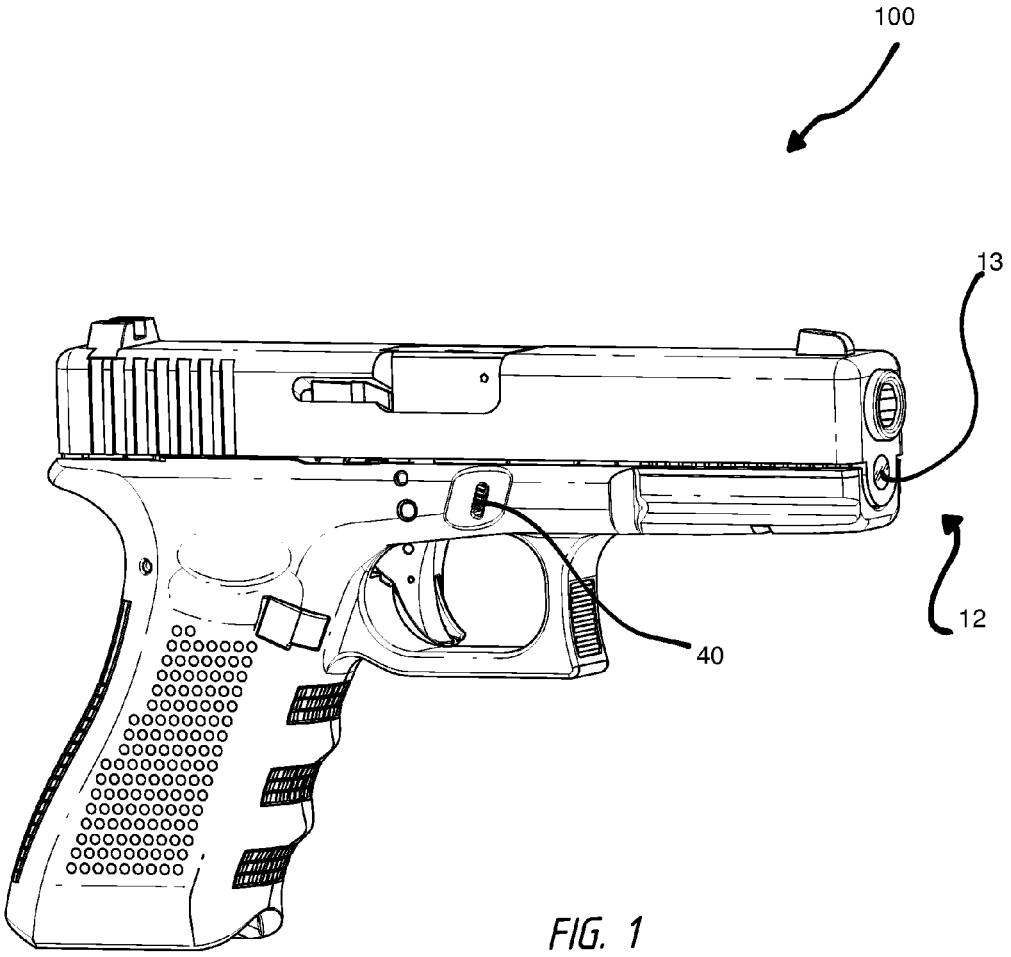
FIG. 1 is an installed perspective view of an exemplary embodiment of the retrofit illumination apparatus of the present invention.

For simplicity and clarity of illustration, the drawing figures illustrate the general manner of construction, and descriptions and details of well-known features and techniques may be omitted to avoid unnecessarily obscuring the invention. Additionally, elements in the drawing figures are not necessarily drawn to scale. For example, the dimensions of some of the elements in the figures may be exaggerated relative to other elements to help improve understanding of embodiments of the present invention. The same reference numerals in different figures denote the same elements.

The terms "first," "second," "third," "fourth." and the like in the description and in the claims, if any, are used for distinguishing between similar elements and not necessarily for describing a particular sequential or chronological order. It is to be understood that the terms so used are interchangeable under appropriate circumstances such that the embodiments described herein are, for example, capable of operation in sequences other than those illustrated or otherwise described herein. Furthermore, the terms "include," and "have," and any variations thereof, are intended to cover a non-exclusive inclusion, such that a process, method, system, article, device, or apparatus that comprises a list of elements is not necessarily limited to those elements, but may include other elements not expressly listed or inherent to such process, method, system, article, device, or apparatus.

The terms "left," "right," "front," "back," "top," "bottom," "over," "under," and the like in the description and in the claims, if any, are used for descriptive purposes and not necessarily for describing permanent relative positions. It is to be understood that the terms so used are interchangeable under appropriate circumstances such that the embodiments of the invention described herein are, for example, capable of operation in other orientations than those illustrated or otherwise described herein.

The terms "couple," "coupled," "couples," "coupling," and the like should be broadly understood and refer to connecting two or more elements or signals, electrically, mechanically or otherwise. Two or more electrical elements may be electrically coupled, but not mechanically or otherwise coupled; two or more mechanical elements may be mechanically coupled, but not electrically or otherwise coupled; two or more electrical elements may be mechanically coupled, but not electrically or otherwise coupled. Coupling (whether mechanical, electrical, or otherwise) may be for any length of time, e.g., permanent or semi-permanent or only for an instant.

DETAILED DESCRIPTION

Illustrative embodiments of the invention are described below. The showings are for purposes of illustrating preferred embodiments and not for purposes of limiting the same. The following explanation provides specific details for a thorough understanding of an enabling description for these embodiments. One skilled in the art will understand that the invention may be practiced without such details.

FIG. 1 is an installed perspective view of an exemplary embodiment of a retrofit illumination apparatus 10 for a firearm 100 in accordance with one embodiment of the present invention. The apparatus 10 comprises a forward or head end 12 out of which light is directed by a light source (not shown in this figure). By way of example, and not limitation, such a light source may be a light emitting diode (LED) which, in one embodiment, may be covered by a lens 13 positioned on the head end 12 of the apparatus 10. The lens 13 is further provided as a means of adjusting a light beam emitted from the light source. The lens 13 is also operative as a means for shielding the apparatus 10 and the contents of the housing, illustrated in FIGS. 5-6, from environmental hazards associated with firearm use. Such hazards may include spray back, led dust, burnt powder, carbon deposits, and other substances.

Figure 2:
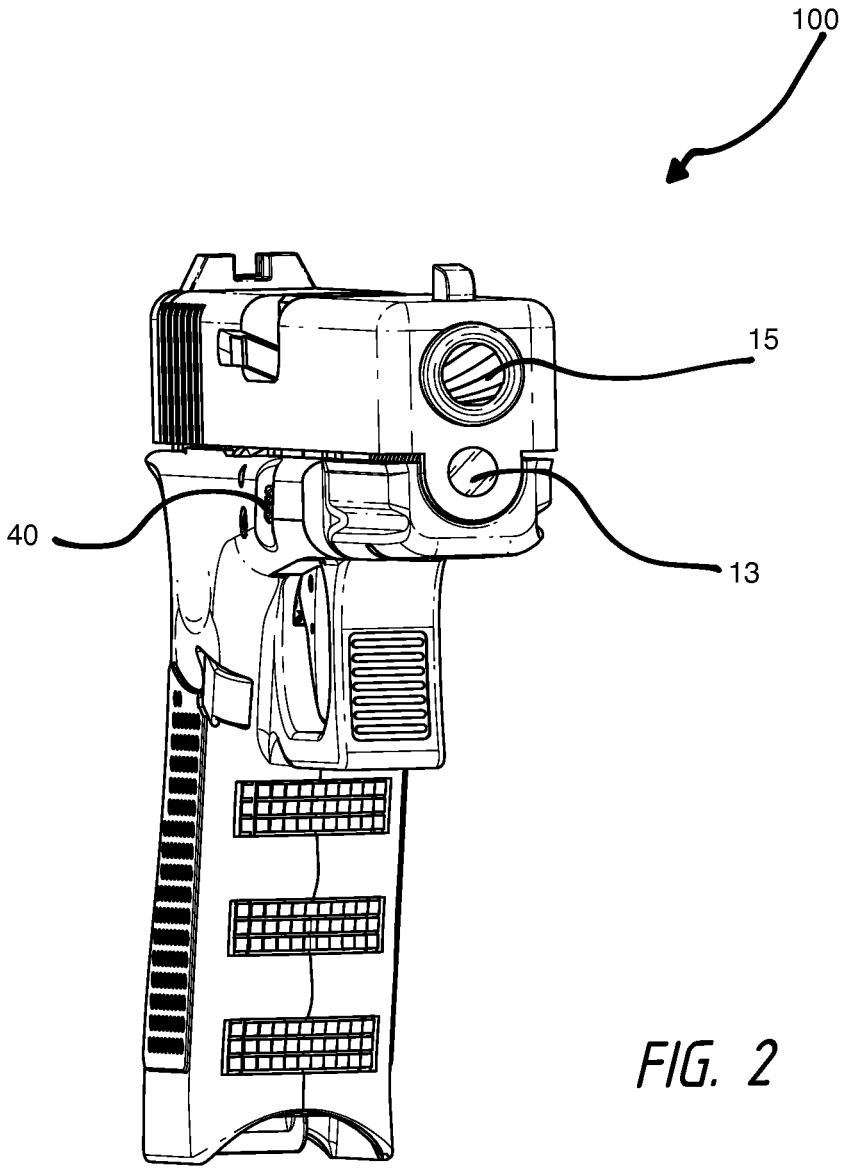
FIG. 2 is a front perspective view of the apparatus of FIG. 1.

FIG. 2 is a front perspective view illustrating the location of the lens 13 with respect to the barrel 15 of the firearm 100. This figure further emphasizes how the light source does not protrude from the front end 12 of the firearm 100. Positioning the light source within the firearm 100 is operative to isolate the light source from environmental hazards which would otherwise damage it. The harsh environments and extreme conditions to which firearms are typically exposed, mean positioning a light source close to the barrel 15 will inevitably impact the quality of light being emitted as well as the lifespan of the light source.

Figure 3:
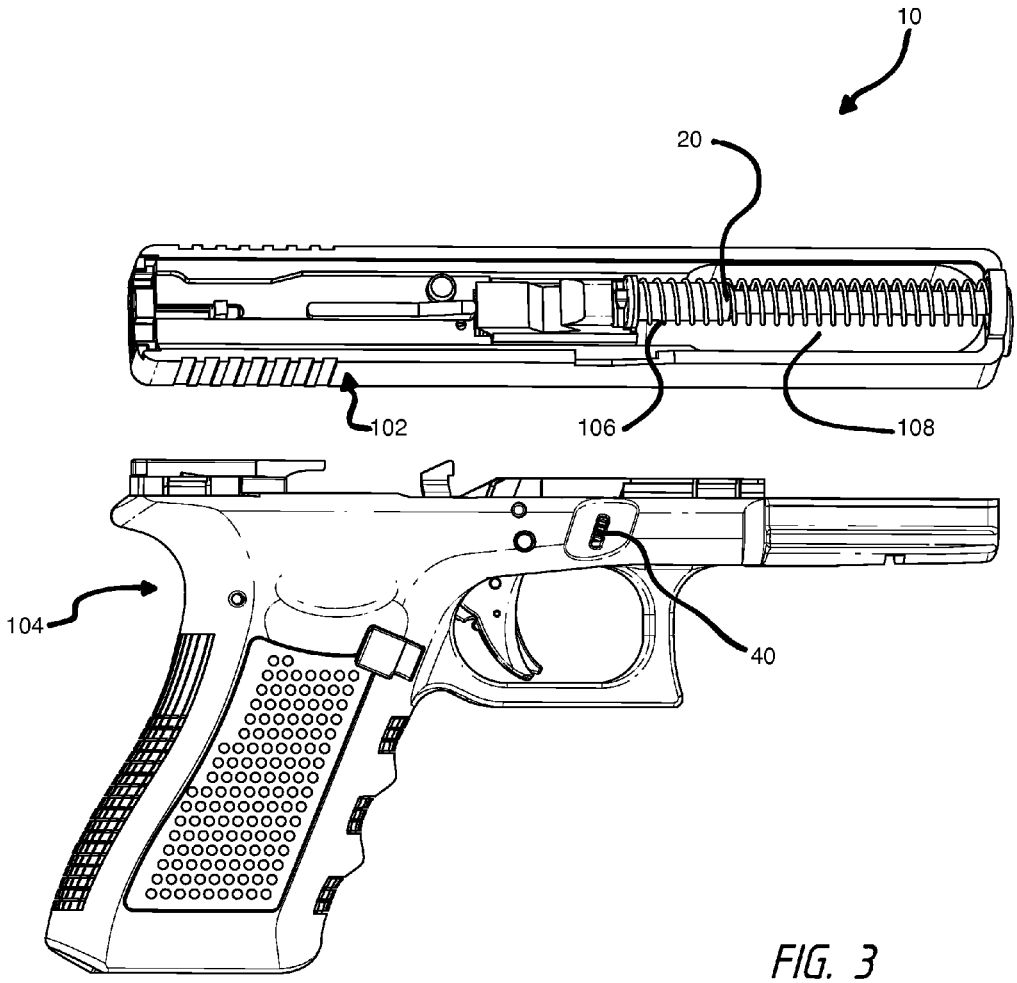
FIG. 3 illustrates the firearm and apparatus of FIG. 1 once the slide has been detached from the firearm body.

FIG. 3 illustrates the firearm 100 once the slide 102 has been detached from the firearm body 104. The slide 102 is shown laying flat on a surface with the underside facing up while the body 104 is shown in profile view. The firearm 100 comprises a recoil spring 106 which is located within a designated compartment 108 beneath the barrel.

Figure 4:
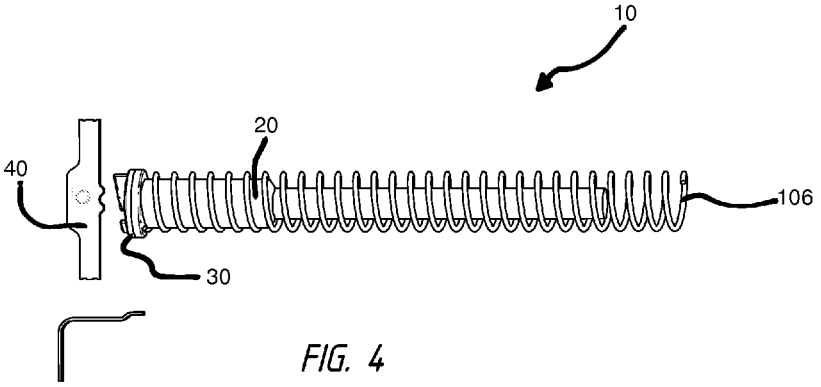
FIG. 4 is an exploded view of the retrofit illumination apparatus.

FIG. 4 is an exploded view of the retrofit illumination apparatus 10 of FIG. 3 illustrating the external and internal components thereof and where the apparatus 10 is removed from within the firearm 100. In this example, the apparatus is placed within the confines of the recoil spring 106. However, this is introduced by way of example and not limitation. One of ordinary skill in the art will recognize that the apparatus 10 of the present invention may be modified to act as a retrofit for any number of different firearms comprising a compartment 108 to house the apparatus 10 and an opening 12 (see FIG. 1) through which light may be emitted.

Figure 5:
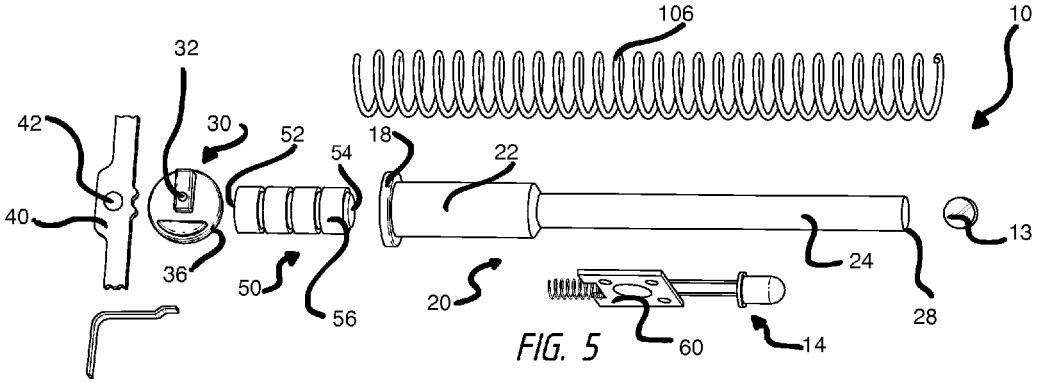
FIG. 5 is an exploded view illustrating one embodiment of the apparatus.

FIG. 5 is an exploded view illustrating one embodiment of the apparatus 10 and the contents of the apparatus housing 20. The housing 20 comprise a front 16 and rear 18, an elongated hollow cylindrical portion 22, and a hollow reduced inner diameter portion 24 proximate to the front end 16 of the housing 20. A circular tail cap 30 overlies the cylindrical housing 20 at the rear 18 of the apparatus 10. The cylindrical housing 20 comprises a plurality of external threads at the rearward end 18 for engaging the internal threads on the inner surface of tail cap 30. A pin 32 protruding from the cap 30 engages a metal switch member 40 that, when installed, protrudes from the sides of the firearm 100 and comprises at least three positions: right, left, and center. The light source 14 may be turned on by either sliding the switch member 40 to the right or to the left. The light source 14 may be turned off by sliding the switch member 40 to the middle position.

The tail cap member 30 is shown removed whereas it would be positioned at the rearward end 18 of the apparatus 10 when installed. The tail cap 30 comprises a generally cylindrical pushbutton 32. The pushbutton 32 further comprises a rearward cylindrical section that projects through a hole in the tail cap 30. In one embodiment, the tail cap 30 is comprised of an insulating plastic and has a circumferential groove to provide a seal between the tail cap 30 and the rear end of the housing 18. The tail cap 30 further comprises a cylindrical skirt 36 extending forwardly from the internal threads and along the housing 20. This also provides greater length thereby facilitating easier grip for rotating tail cap 30 relative to the housing 20.

The apparatus housing 20 comprises a variety of different members fitted together to form the retrofit light emitting apparatus 10 of the present invention. These members further comprise: at least one light source assembly 14 and at least one power source. In one embodiment, the power source may comprise a plurality of batteries 50 each having a negative terminal 52 and a positive terminal 54. By way of example, and not limitation, there may be four batteries connected in series to provide a source of electricity for energizing the light source 14 thus causing it to emit light.

The apparatus is powered by an electricity source which may be positioned in the rearward cavity 22 of the chamber 20. By way of example and not limitation, four batteries 50 may be employed, although a greater or lesser number may be utilized by appropriately extending or shortening the length of the cavity 22. Preferably, batteries are of the of a silver-oxide type. In one embodiment the battery size is 393 and interchangeable with sizes SR48, 193/309/393, SR754, 1136SO, 1137SO which have a typical capacity of 70 mAh milliampere-hour and a diameter of less than 0.8 inch. As a result, the apparatus 10 may have an outer diameter of less than 1 inch. All of the batteries may be shrink wrapped together to facilitate installation and removal from the rearward cavity 22 as well as protect against shorting which may occur should the batteries 50 come into contact with the inside of the hollow chamber 20. Furthermore, in use, these batteries have shown regenerate properties which prolong the their useful life and increase the amount of time in between installation and having to be replaced.

Selective electrical connection between negative terminal 52 of rearward batteries 50 and the rearward end of the tail cap 30 is made via a circular metal plate which is electrically connected to the switch member 40 by the outwardly extending circular metal pin 32. When the switch member 40 is moved to the right or left position relative to the firearm 100 the metal switch member 40 comes into electrical contact with the pin 32 thereby completing an electrical circuit comprising the batteries 50 and light source 14, to the end of applying electrical potential to the light source 14 causing it to emit light.

In one embodiment, the apparatus 10 comprises solid state light source 14, preferably a light-emitting diode (LED). LEDs are available to emit light of one of a variety of colors, e.g., white, red, blue, amber, or green, and have extremely long expected lifetimes, e.g., 100,000 hours. The light source 14 mounts into front portion 24 of the housing 20 with one electrical lead thereof to making electrical contact with the interior surface of the cylindrical housing 20. The other electrical lead projects rearwardly out of the front compartment 24 of the cylindrical housing 20 to come into electrical contact with the positive terminal 54 of forward battery 56, thereby completing an electrical circuit between the power source and housing 20 through light source 14.

In the example illustrated in FIG. 5, current flows from the positive terminal of the power source through a contact, such as the circular metal plate, in the tail cap 30 and the circuit is either opened or closed by the moving the switch 40 to a particular position. The current travels to the barrel 15 via a lug that catches on the switch 40. Next, it travels into the slide 102 and recoil spring 106, and to the housing 20. As illustrated in FIG. 5, the LED anode is electrically coupled to the housing 20 through the LED cathode and through a regulating circuit board 60 to the first negative terminal in the series of batteries 50.

Figure 6:
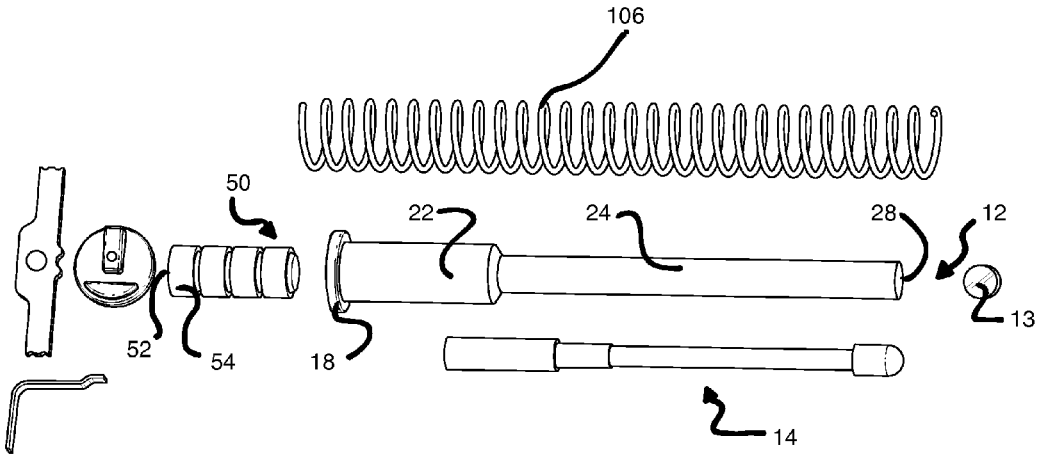
FIG. 6 is an exploded view illustrating a second embodiment of the apparatus.

In the embodiment of the apparatus 10 illustrated in FIG. 6, current flows from the positive terminal of the power source through the contact in the tail cap 30 and the circuit is either opened or closed by the switch 40. The current travels to the barrel 15 via a lug that catches on the switch 40. Next, it travels into the slide 102 and recoil spring 106 and to the housing 20. The embodiment provided by way in FIG. 6 does not comprise a circuit board. Thus, the LED anode is electrically coupled to the housing 20 through the LED cathode directly to the first negative terminal in the series of batteries 50.

Switch member 40 is free to move axially within respect to the housing 20 and tail cap 30, and does so under pressure applied to member 40. Moving the switch member 40 to the middle position brings the metal pin 32 in contact with a nonconductive material 42 selectively positioned in the center of the of the switch member 40 thereby breaking the electrical circuit comprising the batteries 50 and light source 14. This de-energizes the light source 14 and stops the emission of light from the front end of the firearm 100.

Further operative for protecting the light source 14 from environmental hazards related to operating a firearm 100 is the position of the light source 14 within the housing. To further isolate the light source from unnecessary exposure that may effect the functionality of the apparatus 10, it is envisioned that, in one embodiment of the present disclosure, the light emitting end of the light source 14 is positioned within the housing 20 and not protruding from it. By way of example, and not limitation, the light source may be installed so as to be at least 0.25 inches from the front end 12 of the housing 20.

Moreover, in one embodiment of the apparatus 10, light from the light source 14 passes through a lens 13 and is emitted from the front face 12 of the apparatus 10. In another embodiment, the lens 13 may act to modify the light emanating from the light source 14 so that the light emitted from the front of the apparatus 10 is of a uniform intensity throughout a visible light radiating area. Furthermore, in order to improve the luminous reference shape, mask and/or hood means may be provided on the front face of the housing 20.

Although the invention has been described with reference to specific embodiments, it will be understood by those skilled in the art that various changes may be made without departing from the scope of the invention. Accordingly, the disclosure of embodiments is intended to be illustrative of the scope of the invention and is not intended to be limiting. It is intended that the scope of the invention shall be limited only to the extent required by the appended claims. To one of ordinary skill in the art, it will be readily apparent that the devices and method discussed herein may be implemented in a variety of embodiments, and that the foregoing discussion of certain of these embodiments does not necessarily represent a complete description of all possible embodiments. Rather, the detailed description of the drawings, and the drawings themselves, disclose at least one preferred embodiment, and may disclose alternative embodiments.

All elements claimed in any particular claim are essential to the embodiment claimed in that particular claim. Consequently, replacement of one or more claimed elements constitutes reconstruction and not repair. Additionally, benefits, other advantages, and solutions to problems have been described with regard to specific embodiments. The benefits, advantages, solutions to problems, and any element or elements that may cause any benefit, advantage, or solution to occur or become more pronounced, however, are not to be construed as critical, required, or essential features or elements of any or all of the claims, unless such benefits, advantages, solutions, or elements are stated in such claim.

Moreover, embodiments and limitations disclosed herein are not dedicated to the public under the doctrine of dedication if the embodiments and/or limitations: (1) are not expressly claimed in the claims; and (2) are or are potentially equivalents of express elements and/or limitations in the claims under the doctrine of equivalents

CONCLUSIONS, RAMIFICATIONS, AND SCOPE

While a particular form of the invention has been illustrated and described, it will be apparent that various modifications can be made without departing from the spirit and scope of the invention. For example, the apparatus is illustrated as being installed in one particular firearm in some embodiments even though the inventors contemplate the possibility that it may installed in a variety of different firearms all the while comprising the properties of the invention. Accordingly, is not intended that the invention be limited, except as by the appended claims.

The teachings provided herein can be applied to other systems, not necessarily the apparatus described herein. The elements and acts of the various embodiments described above can be combined to provide further embodiments. All of the above patents and applications and other references, including any that may be listed in accompanying filing papers, are incorporated herein by reference. Aspects of the invention can be modified, if necessary, to employ the systems, functions, and concepts of the various references described above to provide yet further embodiments of the invention.

Particular terminology used when describing certain features or aspects of the invention should not be taken to imply that the terminology is being refined herein to be restricted to any specific characteristics, features, or aspects of the retrofit firearm illumination apparatus with which that terminology is associated. In general, the terms used in the following claims should not be constructed to limit the apparatus to the specific embodiments disclosed in the specification, unless the above description section explicitly define such terms. Accordingly, the actual scope encompasses not only the disclosed embodiments, but also all equivalent ways of practicing or implementing the disclosed apparatus. The above description of embodiments of the apparatus is not intended to be exhaustive or limited to the precise form disclosed above or to a particular field of usage. While specific embodiments of, and examples for, the retrofit firearm illumination apparatus are described above for illustrative purposes, various equivalent modifications are possible which those skilled in the relevant art will recognize.

While certain aspects of the retrofit firearm illumination apparatus are presented below in particular claim forms, the inventor contemplates the various aspects of the apparatus in any number of claim forms. Accordingly, the inventor reserves the right to add additional claims after filing the application to pursue such additional claim forms for other aspects of the retrofit firearm illumination apparatus.

What is claimed is:

1. A retrofit illumination apparatus comprising:

a cylindrical housing having a reduced inner diameter portion and a hole at a forward end thereof, wherein said housing is electrically conductive;

a solid state light source located in said housing for projecting light from said apparatus when said light source is energized, said solid state light source having first and second electrical leads, the first electrical lead making electrical contact to said housing;

a plurality of batteries in series connection in said housing and connected to the second electrical lead of said solid state light source;

a tail cap attached to said housing at a rearward end thereof; and a spring-loaded metal pin located in said tail cap movable axially therein for selectively connecting said solid state light source and said batteries in circuit for causing said solid state light source to produce light;

a light-emitting lens covering the hole at the forward end of the housing; and a horizontally sliding switch with at least three positions comprising a first, second, and third position located outside said tail cap for selectively connecting said plurality of batteries to said metal housing, whereby said solid state light source and said batteries are selectively connected in circuit for causing said solid state light source to selectively produce light responsive to sliding said switch to either the first or third position.

2. The apparatus of claim 1 wherein said circuit comprises said electrically conductive housing.

3. The apparatus of claim 2 wherein said spring-loaded pin in said cap comprises:

a metal contact having a circular periphery proximate said pin and having a central opening therethrough, said metal contact engaging said pushbutton and being movable with said pushbutton for selectively making an electrical connection between said battery and the conductive end of said conductive housing; and a spring for biasing said metal contact and said pin away from the conductive end of said flashlight housing, whereby said light source and said battery are selectively connected in circuit by said metal contact for causing said light source to selectively produce light responsive to moving said pin.

4. The apparatus of claim 1 wherein the conductive end of said housing and said cap each include threads attaching said cap to the conductive end of said housing, whereby rotating one of said flashlight housing and said cap relative to the other one thereof causes said cap to move axially in relation to the conductive end of said flashlight housing; and wherein rotating said cap relative to the conductive end of said flashlight housing moves the metal contact into electrical contact with the conductive end of said flashlight housing.

5. The apparatus of claim 1 wherein said batteries are wrapped in plastic.

6. The apparatus of claim 5 comprising at least three of said batteries wherein said batteries are coupled together.

7. The apparatus of claim 1 wherein said a light-emitting lens further comprises modifying means for producing substantially uniform light intensity throughout the visible light radiating from said light source.

8. The apparatus of claim 1 wherein said light source is a light emitting diode.

9. A retrofit illumination apparatus comprising:

maintube assembly including adjacent first and second portions, said first portion defining a first receiving space and a first beam outlet in open communication therewith, said second portion defining a second receiving space;

a lens cover secured to a front of said first portion, said front cover defining a beam outlet communicating with said first beam outlet;

a light source disposed in said first receiving space;

a plurality of batteries disposed within said second receiving space for powering said light source; and switch means coupled to said batteries for actuating said light source wherein said switch means comprises at least three positions comprising a first, second, and third position selectively operable to cause the light source to emit light in the first and third positions and operable to turn off the light source in the second position.

10. The apparatus of claim 9 wherein said light source is a light-emitting diode.

11. The apparatus of claim 9 wherein said batteries are low drain self regenerating batteries.

12. A retrofit illumination apparatus for use on a firearm of the type adapted to contain and discharge a load of ammunition and having a central longitudinal axis extending from a proximal and zone, including a proximal end, to a distal end zone, and a barrel extending along the central axis between the proximal and zone and distal end zone, said assembly adapted to fit in a compartment below said barrel comprising within a recoil spring and to project light along said central axis, said apparatus comprising:

a cylindrical housing having a reduced inner diameter portion and a hole at a forward end thereof, wherein said housing is electrically conductive;

a light source located in said housing for projecting light from said apparatus when said light source is energized, said light source having first and second electrical leads, the first electrical lead making electrical contact to said housing;

a plurality of batteries in series connection in said housing and connected to the second electrical lead of said solid state light source;

a tail cap attached to said housing at a rearward end thereof; and a spring-loaded metal pin located in said tail cap movable axially therein for selectively connecting said light source and said batteries in circuit for causing said solid state light source to produce light;

a light-emitting lens covering the hole at the forward end of the housing; and a horizontally sliding switch with at least three positions comprising a first, second, and third position located outside said tail cap for selectively connecting said plurality of batteries to said metal housing, whereby said light source and said batteries are selectively connected in circuit for causing said solid state light source to selectively produce light responsive to sliding said switch to either the first or third position.

13. The apparatus of claim 12 wherein said circuit comprises said electrically conductive housing.

14. The apparatus of claim 13 wherein said spring-loaded pin in said cap comprises:

a metal contact having a circular periphery proximate said pin and having a central opening therethrough, said metal contact engaging said pushbutton and being movable with said pushbutton for selectively making an electrical connection between said battery and the conductive end of said conductive housing; and a spring for biasing said metal contact and said pin away from the conductive end of said flashlight housing, whereby said light source and said battery are selectively connected in circuit by said metal contact for causing said light source to selectively produce light responsive to moving said pin.

15. The apparatus of claim 12 wherein the conductive end of said housing and said cap each include threads attaching said cap to the conductive end of said housing, whereby rotating one of said flashlight housing and said cap relative to the other one thereof causes said cap to move axially in relation to the conductive end of said flashlight housing; and wherein rotating said cap relative to the conductive end of said flashlight housing moves the metal contact into electrical contact with the conductive end of said flashlight housing.

16. The apparatus of claim 12 wherein said batteries are wrapped in plastic.

17. The apparatus of claim 12 comprising at least three of said batteries wherein said batteries are coupled together.

18. The apparatus of claim 12 wherein said a light-emitting lens further comprises modifying means for producing substantially uniform light intensity throughout the visible light radiating from said light source.

19. The apparatus of claim 12 wherein said light source is a light emitting diode.

* * * * *